United States Patent [19]

Gardner

[11] Patent Number: 4,874,189

[45] Date of Patent: Oct. 17, 1989

[54] ADJUSTABLE SPACER DEVICE

[76] Inventor: Geno P. Gardner, 43 Willow Street, Mystic, Conn. 06355

[21] Appl. No.: 29,651

[22] Filed: Mar. 23, 1987

[51] Int. Cl.[4] ..... F16L 41/00

[52] U.S. Cl. ..... 285/39; 285/64; 285/158

[58] Field of Search ..... 285/8, 39, 61, 64, 158, 285/159, 161

[56] References Cited

U.S. PATENT DOCUMENTS

| | | | |
|---|---|---|---|
| 852,220 | 4/1907 | Cecil . | |
| 1,043,835 | 11/1912 | Hinsdale | 285/64 X |
| 1,471,154 | 10/1923 | Graham | 285/61 X |
| 1,505,279 | 8/1924 | Mueller . | |
| 1,650,057 | 11/1927 | Wernle | 285/64 X |
| 1,709,132 | 4/1929 | Hinsdale | 285/61 X |
| 2,566,060 | 8/1951 | Ells et al. | 285/158 |
| 3,014,222 | 12/1961 | Pope | 285/64 |
| 3,144,213 | 8/1964 | Hedlund | 285/158 X |
| 3,261,577 | 7/1966 | DeGryse | 248/27 |
| 3,386,671 | 6/1968 | Turner | 285/158 |
| 3,415,548 | 12/1968 | Goodman et al. | 285/158 X |
| 3,477,747 | 11/1969 | Clements | 285/158 |
| 3,540,065 | 11/1970 | Gidner et al. | 285/64 |
| 3,640,305 | 2/1972 | Young | 137/360 |
| 4,108,477 | 8/1978 | Morris | 285/64 |

FOREIGN PATENT DOCUMENTS

| | | | |
|---|---|---|---|
| 9542 | 8/1912 | United Kingdom | 285/158 |
| 1559075 | 1/1980 | United Kingdom | 285/61 |

*Primary Examiner*—Randolph A. Reese
*Assistant Examiner*—Anthony Knight
*Attorney, Agent, or Firm*—Anthony G. Eggink

[57] ABSTRACT

An adjustable spacer device for communicatively connecting a water supply pipe to a faucet fixture and for adjustably securing the faucet to a vertically disposed sink portion. The adjustable spacer device is comprised of a flanged elbow conduit of a predetermined diameter having an inlet end and an outlet end. The elbow conduit has a circumferentially disposed flange at the outlet end and has a plurality of threaded apertures therethrough. The adjustable spacer device also has a plurality of threaded bolt members for adjustably threading through the plurality of threaded apertures. The bolt members each have an elongated threaded bottom portion and an end portion for turning the bolt members. Also included in the adjustable spacer device is an annular rigid plate member having opposing faces, one face being for abutment with the threaded bolt member ends and the other face being for engaging the back portion of the verical sink portion. The plate member has a centrally disposed aperture for the communicative extension of the faucet fixture.

13 Claims, 1 Drawing Sheet

ADJUSTABLE SPACER DEVICE

BACKGROUND OF THE INVENTION

This invention relates to an adjustable spacer device to secure and support faucets to sinks. Particularly, this invention relates to an adjustable spacer device that is primarily usable in commercial settings to enable a plumber to connect faucet fixtures to the water supply pipes that extend upwardly within or adjacent to building walls.

The adjustable spacer device according to the invention is useful for mounting plumbing fixtures to the ledge mount or vertically extending portion of commercial type sinks, as opposed to the deck mount or horizontal sink surface mounts that are most common in residential settings.

Plumbers have utilized various techniques and devices such as a number of washers to space and secure fixtures in this particular setting, or they have relied on the strength of the plumbing connections themselves to secure the fixture with respect to the sink. These techniques and arrangements are costly, time consuming and generally lead to unstable connections that result in subsequent leaks. The adjustable spacer device of this invention is provided to overcome the inadequacies and difficulties of these spacing techniques and connector configurations.

In the past, several types of mounting devices have been proposed or utilized for plumbing related purposes. However, these devices have generally been unrelated to resolving the problems and difficulties associated with the aligning and joining of faucent fixtures to water inlet pipes that are located behind a commercial type sink, hidden from view, and, consequently, difficult to connect.

And, despite the long standing need for an economical and easy to use adjustable spacer device for supporting and securing faucet fixtures to sinks, none in so far as in known, has been developed.

SUMMARY OF THE INVENTION

An adjustable spacer device is provided for communicatively connecting a water supply pipe to a faucet fixture and for adjustably securing the faucet to a vertically disposed sink portion. The adjustable spacer device is comprised of a flanged elbow conduit of a predetermined diameter having an inlet end and an outlet end.

The elbow conduit has a circumferentially disposed flange at the outlet end and has a plurality of threaded apertures therethrough. The adjustable spacer device also has a plurality of threaded bolt members for adjustably threading through the plurality of threaded apertures. The bolt members each have an elongated threaded bottom portion and an end portion for turning the bolt members.

Also included in the adjustable spacer device is an annular rigid plate member having opposing faces, one face being for abutment with the threaded bolt member ends and the other face being for engaging the back portion of the vertical sink portion. The plate member has a centrally disposed aperture therethrough which has a diameter equal to or slightly larger than the diameter of the elbow conduit and being for the communicative extension therethrough of the faucet fixture.

Also provided by the adjustable spacer device of this invention are devices having its flanged portion separated or apart from the body of the flanged elbow and adjustable spacer device elements and constructions that further permit the joining of water supply pipes to faucet fixtures that are out of view and difficult to align and connect.

Finally, provided by the teachings of this invention are processes for adjustably connecting faucet fixtures to water supply pipes in the installation of commercial type sinks.

These and other benefits of this invention will become clear from the following description by reference to the drawings.

DESCRIPTION OF THE PREFERRED EMBODIMENTS

Figure 1:
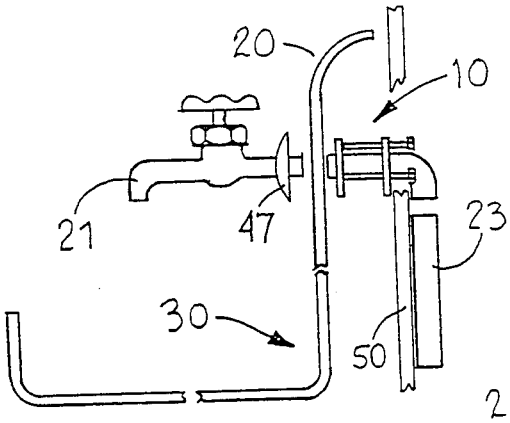
FIG. 1 is a lateral plan view of the adjustable spacer device of the invention.

Referring to FIG. 1, the adjustable spacer device 10 of this invention is shown in conjunction with a sink 30 having a vertically extending ledge or sink portion 20. The elements of the device 10 are shown spaced apart for clarity. This type of sink configuration is most commonly used in commercial settings, i.e., restaurants, hospitals, manufacturing facilities, etc.

As can be appreciated, with the requirement of the sink 30 to have its vertically extending deck portion 20 to be in contact with a building wall 50, it is difficult for a plumber to align and connect a faucet fixture 21 to a water supply pipe 23 located behing the wall 50, as shown in FIG. 1.

Additionally, because sinks 30 are typically constructed of lightweight and/or pliable materials such as stainless steel, aluminum, fiberglass and the like, it is imperative that any connecting mechanism has a configuration which minimizes possible damage to the sink when a faucet is connected to the water supply pipe and secured.

Figure 2:
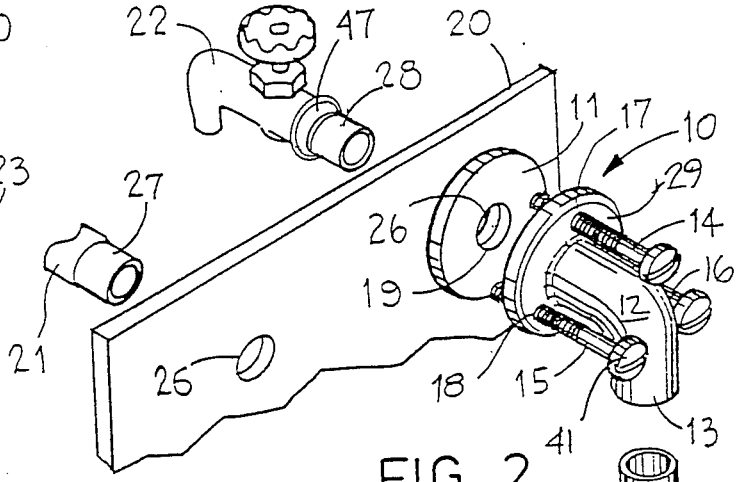
FIG. 2 is a perspective view of the adjustable spacer device of the invention showing the water supply pipe and the faucet fixture to be communicatively connected thereby.

As shown in FIG. 2, the spacer device 10 is in a position to be used to secure, support and connect to the nipple ends 27 and 28 of faucet fixtures 21 and 22, i.e., hot and cold water faucets, respectively. Two apertures or holes 26 extend through the deck portion 20 of sink 30 for puposes of connecting the device 10 of this invention to nipple ends 27 and 28. The faucet fixture 22 is shown to have a cover plate 47 for subsequently covering the aperture 26. The adjustable spacer device 10 provides an adjustable means to connect the faucets 27 and 28 to the water inlet pipes or conduits, i.e., water pipe 23 ($\frac{1}{2}$ inch D.) as shown in the drawing figures.

FIG. 2 also shows the components or elements of the adjustable spacer device 10. The spacer and securement device 10 has a washer element 11 which has a centrally disposed aperture 19 for receiving therethrough the pipe or nipple extension 28 of the faucet fixture 22. Although the washer 11 is shown having a circular configuration, other shapes or configurations may also be utilized. The washer element 11 ultimately receives the impact of the screws or bolts 14, 15 and 16 having screw heads 41 and essentially distributes that force uniformly to the sink portion 20. This force distribution, which is dependent upon the construction and area of the washer 11, minimizes any potential damage to the rear of the sink.

The adjusting spacer device 10 additionally has a flanged sink elbow 12 which, in FIG. 2, is shown to have a 90 degree downward extension 13 and an annular flanged portion 29. The flanged portion 29 of elbow 12 has three equidistantly disposed threaded apertures or holes, as shown by 17 and 18, through which screws 14, 15 and 16 are threaded. The screws 14, 15 and 16 when threaded through their respective apertures abut the washer element 11 and continued threading permits the plumber to space the elbow extension 13 any desired distance from the sink so as to align it with a water inlet pipe 23, for example.

The adjustable spacer device 10 and its respective elements, such as the flanged elbow 12, washer element 11 and the screws 14, 15 and 16, are preferably constructed of a metal or a metal alloy or a galvanized structure, although other plumbing supply materials as known in the art may also be used, such as plastic components, i.e., P.V.C.

Figure 3:
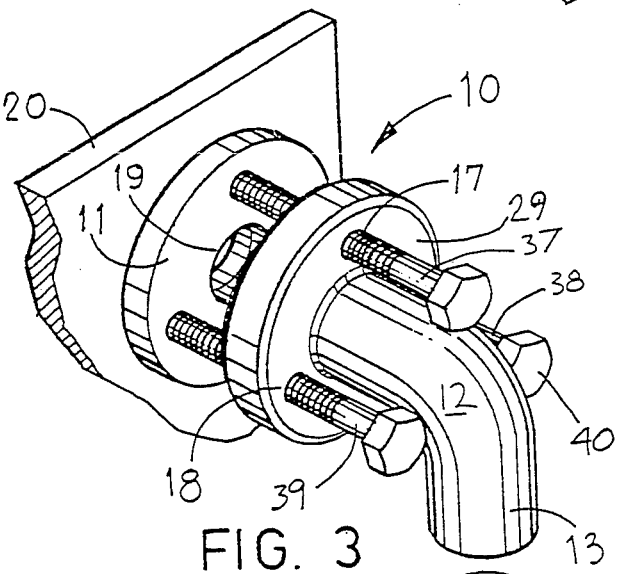
FIG. 3 is a perspective view of another embodiment of the adjustable spacer device of the invention.

FIG. 3 illustrates the adjustable spacer device 10 as having the flanged sink elbow 12 and the washer element 11 used in conjunction with threaded bolts 37, 38 and 39 having hexagonal heads 40. The hexagonal heads 40 permit a plumber to utilize standard wrenches to engage and turn the threaded bolts from difficult to reach and tight locations.

Figure 4:
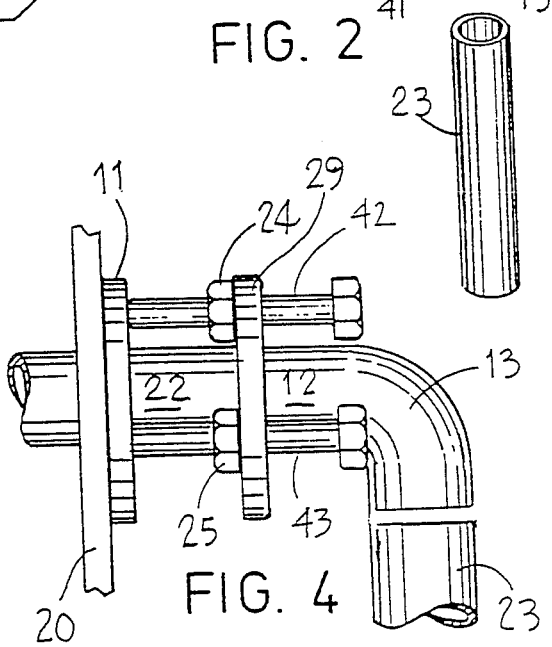
FIG. 4 is a lateral plan view of yet another embodiment of the adjustable spacer device of the invention.

FIG. 4 is a side view of another embodiment of the adjustable spacer device wherein the threading in the sink apertures or holes of the flanged elbow 12 are not present and whereby, nuts 24 and 25 are utilized. The nuts 24 and 25 are adjustably threaded onto the threaded portions of bolts 42 and 43 to abut the exterior flanged portion 29 of sink elbow 12. In this configuration, a biasing force is exerted by the nuts 24 and 25 onto the flange 29 as bolts 42 and 43 are tightened against the washer element 11.

Figure 5:
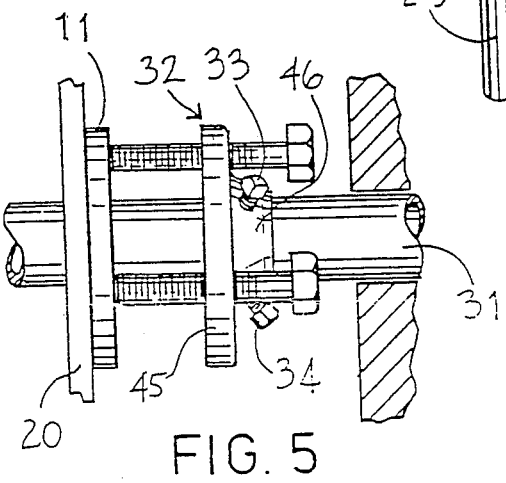
FIG. 5 is a lateral plan view of another embodiment of the adjustable spacer device of the invention showing the communicative connection to a horizontally disposed water supply pipe.

FIG. 5 illustrates another embodiment of the adjustable spacer device. This embodiment utilizes a flanged washer member 32 that is comprised of a flanged portion 45 extending outward from tapered annular base portion 46. Set screws 33 and 34 are provided to fix the flanged washer device 32 about water inlet pipe 31. Once the set screws 33 and 34 are used to set the flanged member 32, the threaded bolts are extended through the internally threaded apertures in the flanged portion 45 to abut the washer member 11. This device embodiment is useful when the incoming water supply pipe 31 extends horizontally towards the faucet fixture, as through a wall 50, for example.

Figure 6:
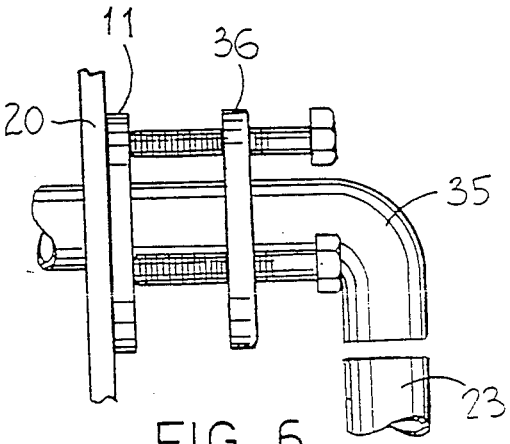
FIG. 6 is a lateral plan view of another embodiment of the adjustable spacer device according to the teachings of this invention.

FIG. 6 illustrates another embodiment of this invention wherein the flanged sink elbow 12 of device 10 is replaced by an elbow 35 not having an integral flanged portion 29. Instead, a second washer 36 having a central aperture with a diameter smaller than the outside diameter of elbow 35 but larger than its inside diameter and three equidistant threaded holes in its body is used in conjunction with threaded bolts, i.e., 42 and 43, and an abutment washer member 11. Thus, the opposing washers 11 and 36 respectively abut the rear of the sink ledge 20 and the elbow 35 to secure a faucet fixture in place.

In the process of connecting a faucet fixture to a water supply pipe, the plumber initially provides an adjustable spacer device, as described in this specification. The spacer device is initially adjusted by threading the screws 14, 15 and 16 or bolts 37, 38 and 39, whereby the washer element 11 and the downward extension 13 of the flanged sink elbow 12 are respectively aligned with the rear of the sink portion 20 and the water supply pipe 23. Next, the nipple end 28 of the faucet fixture 22, for example, is secured in the flanged apertured portion of the elbow 12. Securement can be by threading, i.e., threaded nipple end of the faucet fixture to the internally threaded flanged elbow, or by sweating these elements in place. Finally, the downward extension 13 of the flanged elbow, for example, is similarly connected to the water supply pipe 13. Depending upon accessibility and the preference of the plumber, the sequence of connecting the faucet fixture and water supply pipe 23 to the adjustable spacer device can be reversed.

Thus, in use, a plumber connects the flanged elbow 12 to the nipple extension 28 of faucet 22, and then by the proper threading of screws 14, 15 and 16, is able to properly and securely align the downward extension 13 to the pipe 23 for connection as discussed above. The spacer device 10 permits the holding and securing force for the fixture to be horizontally directed by means of the screws to washer 11 which abuts the rear of the sink ledge. Direct contact by the screws would damage the sink ledge portion 20.

In summary, the abutment washer elements 11 receive the ends of the bolt members 14, 15 and 16, for example, to thereby evenly distribute the forces over the entire body of the washer 11. This configuration prevents damage to the rear of the ledge portion 20 of sink 30. Additionally, once secured, this configuration is more stable and more quickly assembled to reduce the possibility of leak problems after assembly.

Although the devices of this invention have been discussed to have equidistantly located threaded screws 14, 15 and 16, threaded bolts 37, 38 and 39 and set screws 33 and 34, it is within the purview of the invention to utilize any number of these components as long as the device structure is stable. Thus, three such components have been found suited for this purpose, although different numbers could be utilized.

As can be appreciated to those skilled in the art, the use of the adjustable spacer device described herein can be adapted for similar spacing and securing purposes other than for the specific purpose of connecting faucet fixtures to water supply pipes in conjunction with commercial sinks.

As many changes are possible to the embodiments of the adjustable spacer device utilizing the teachings of the invention, the descriptions above and the accompanying drawings should be interpreted in the illustrative and not in the limited sense.

What is claimed is:

1. An adjustable spacer device constructed and arranged to aid in the alignment and connection of a water supply pipe to a faucet fixture and for adjustably securing the faucet to the rear of an installed and difficult to reach vertically disposed sink portion, said adjustable spacer device comprising:

a) a flanged elbow conduit of a predetermined diameter having an inlet end and an outlet end, said elbow conduit having a circumferentially disposed flange at said outlet end and having a plurality of spaced and threaded apertures therethrough, b) a plurality of threaded bolt members for the adjustable threading through said plurality of threaded apertures, said bolt members each having an elongated threaded bottom portion and an end portion for turning said bolt members, said threaded portion of each said bolt member being threaded through said elbow flange a predetermined outward distance with respect to said flanged elbow outlet end, and c) an annular rigid plate member parallel spaced from said elbow conduit flange and having opposing faces, one face being for abutment with said threaded bolt member ends and said other face being for engaging only the back portion of the vertical sink portion, said plate member having a centrally disposed aperture therethrough having a diameter generally equal to the diameter of said elbow conduit and being for the communicative extension of the faucet fixture therethrough whereby, said device is initially adjustable by means of said bolt members with respect to said annular plate member and said elbow conduit to align said device with the faucet fixture and the water supply pipe.

2. The adjustable spacer device of claim 1, wherein said flanged portion is separated from the body of said flanged elbow.

3. The adjustable spacer device of claim 1, wherein said threaded bolt members have slotted head portions for receiving the end of a screwdriver.

4. The adjustable spacer device of claim 1, wherein said threaded bolt members have hexagonal head portions for receiving the end of a wrench for turning said bolt members.

5. The adjustable spacer device of claim 1, wherein said device additionally has a plurality of second threaded nut members for abutting the forward surface of said flange member.

6. The adjustable spacer device of claim 1, wherein said device is constructed of a metal alloy material.

7. The adjustable spacer device of claim 1, wherein said inlet end of said flanged elbow device has a diameter larger than the water supply pipe to which it is communicatively connected.

8. The adjustable spacer device of claim 1, wherein said flanged elbow conduit is disposed at a 90 degree angle.

9. An adjustable spacer device for communicatively connecting a water supply pipe to a faucet fixture and for adjustably securing a faucet to a vertically disposed sink portion, said adjustable spacer device comprising:

a) a rigid, annular and adjustable body member for securement to and for placement circumferentially about a water supply pipe, said adjustable body member having a centrally disposed aperture therethrough and having a tapered outer end portion and a vertically extending flange member integral with the opposite end portion and having a plurality of first apertures therethrough, said tapered end portion further having a plurality of second threaded apertures therethrough, b) a plurality of set screw members for threading into said second threaded apertures ins aid tapered end portion of said body member for securing said body member to the water supply pipe, c) a plurality of threaded bolt members for the adjustable threading through said plurality of first threaded apertures, said bolt members each having an elongated threaded bottom portion and an end portion for turning said bolt members, said threaded portion of each said bolt member being threaded through said body member flange a predetermined outward distance with respect to said flange end, and d) an annular rigid plate member for abutment with said threaded bolt member ends and for engaging only the back portion of the vertical sink portion, said plate member having a centrally disposed aperture therethrough having a diameter generally equal to that of said body member, and being for the communicative extension of the faucet fixture therethrough whereby, said device is initially adjustable by means for said bolt members with respect to said annular plate member and said flanged body member to align said device with the faucet fixture and the water supply pipe.

10. The adjustable spacer device of claim 9, wherein said threaded bolt members have slotted head portions for receiving the end of a screwdriver.

11. The adjustable spacer device of claim 9, wherein said threaded bolt members have hexagonal head portions for receiving end of a wrench for turning said bolt members.

12. The adjustable spacer device of claim 9, wherein said device is constructed of a metal alloy material.

13. The adjustable spacer device of claim 9, wherein said device further has an elbow conduit disposed at a 90 degree angle and wherein said body member is connected to said elbow conduit.

* * * * *